US008038125B2

(12) United States Patent
Troy et al.

(10) Patent No.: US 8,038,125 B2
(45) Date of Patent: Oct. 18, 2011

(54) APPARATUS AND METHODS FOR LIFTING AND LOWERING VERTICALLY MOUNTED DEVICES

(75) Inventors: James J. Troy, Issaquah, WA (US); Burke R. Magee, Carnation, WA (US); Steven C. Venema, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 298 days.

(21) Appl. No.: 12/368,702

(22) Filed: Feb. 10, 2009

(65) Prior Publication Data

US 2010/0202868 A1 Aug. 12, 2010

(51) Int. Cl.
*B66D 1/36* (2006.01)

(52) U.S. Cl. ..... 254/338; 254/324; 254/327

(58) Field of Classification Search ..... 254/323, 254/270, 286, 324, 327, 338
See application file for complete search history.

(56) References Cited

U.S. PATENT DOCUMENTS

| | | | | |
|---|---|---|---|---|
| 5,096,022 | A | 3/1992 | Bowers | |
| 5,427,356 | A * | 6/1995 | Krotov et al. | 254/324 |
| 5,593,139 | A * | 1/1997 | Julian | 254/325 |
| 6,948,734 | B2 * | 9/2005 | Popham | 280/478.1 |
| 6,951,345 | B2 * | 10/2005 | Wilks | 280/477 |
| 7,290,755 | B1 * | 11/2007 | Thibodeaux | 254/323 |

* cited by examiner

*Primary Examiner* — Emmanu M Marcelo
(74) *Attorney, Agent, or Firm* — Klintworth & Rozenblat IP LLC

(57) ABSTRACT

A lifting and lowering apparatus may include: at least one cable, at least one pulley connected to the at least one cable, at least one drive member connected to the at least one cable for driving the at least one cable in at least one direction, a moveable payload attachment member for attaching to a payload to be at least one of lifted and lowered, an attachment member guide attached to the moveable payload attachment member, and an alignment guide for positioning at a position. The moveable payload attachment member may be at least one of lifted and lowered by the at least one cable. Both the attachment member guide and the alignment guide may be shaped to force the attachment member guide into a predetermined mating position and orientation against the alignment guide at the position.

36 Claims, 6 Drawing Sheets

APPARATUS AND METHODS FOR LIFTING AND LOWERING VERTICALLY MOUNTED DEVICES

FIELD OF THE DISCLOSURE

The disclosure relates to apparatus and methods for lifting and lowering vertically mounted devices.

BACKGROUND OF THE DISCLOSURE

Conventional methods and/or apparatus for installing payloads, such as electrical devices, in a raised or lowered final installation location typically require a technician to move the payload from the starting location to the final installation location, attach the payload to a structure at the final installation position, and to then run network, signal, or power cables to the payload. The payload may comprise one or more active devices that require some form of wired connection, or items that do not need a wired connection. Installation methods and/or apparatus often require multiple people, ground support equipment, such as mobile lift vehicles, scissor lifts, and/or other types of lift equipment, and require the final installation position to have enough clearance for the ground support equipment. Making adjustments to, maintaining, and/or removing the payload after it is installed may be difficult since the technician may need to be moved to the final installation location, and/or the payload may need to be disconnected and brought back to the starting location.

A lifting and lowering apparatus is needed to reduce and/or solve one or more problems of one or more conventional methods and/or apparatus for installing, replacing, and/or maintaining payloads at final installation locations which are removed from a starting location.

SUMMARY OF THE DISCLOSURE

In one aspect of the disclosure, a lifting and lowering apparatus may be provided. The lifting and lowering apparatus may comprise: at least one cable; at least one pulley connected to the at least one cable; at least one drive member connected to the at least one cable for driving the at least one cable in at least one direction; a moveable payload attachment member for attaching to a payload to be at least one of lifted and lowered; an attachment member guide attached to the moveable payload attachment member; and an alignment guide for positioning at a position. The moveable payload attachment member may be at least one of lifted and lowered by the at least one cable. Both the attachment member guide and the alignment guide may be shaped to force the attachment member guide into a pre-determined mating position against the alignment guide at the position.

In another aspect of the disclosure, a method may be provided of moving a payload. In one step, a payload may be attached to a payload attachment member connected to at least one cable. In another step, the payload and the payload attachment member may be moved from a starting position to another position by using at least one drive member to move the cable. In yet another step, an attachment member guide attached to the payload attachment member may be aligned with an alignment guide at the another position to force the attachment member guide into only a pre-determined mating position relative to the alignment guide. In still another step, the attachment member guide of the payload attachment member may be locked in the pre-determined mating position relative to the alignment guide to secure the payload in place at the another position.

These and other features, aspects and advantages of the disclosure will become better understood with reference to the following drawings, description and claims.

DETAILED DESCRIPTION OF THE DISCLOSURE

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
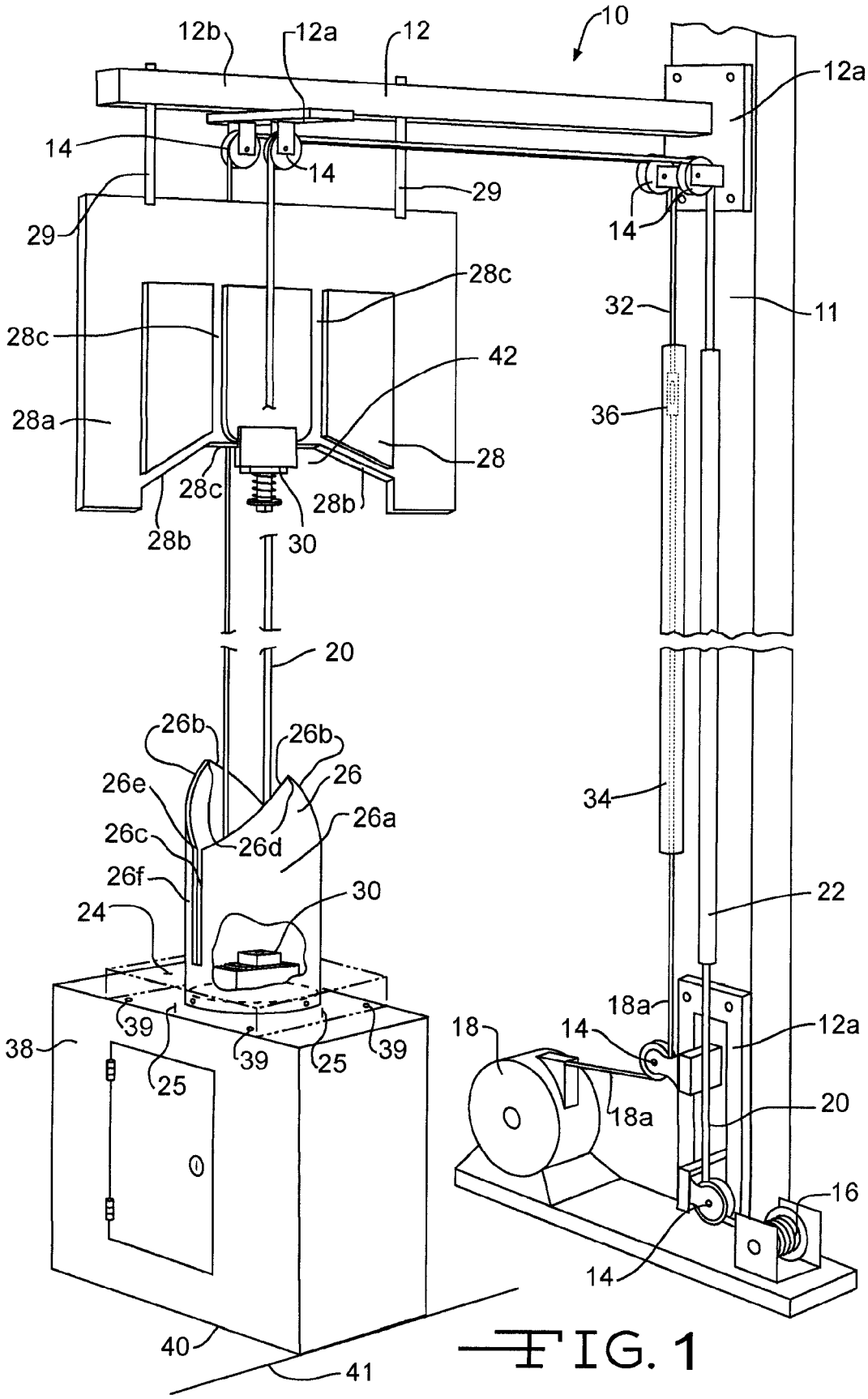
FIG. 1 is a perspective view of one embodiment of a lifting and lowering apparatus having a payload at a starting position.

FIG. 1 depicts a perspective view of one embodiment of a lifting and lowering apparatus 10 with a payload 38 at a starting position 40. The lifting and lowering apparatus 10 may be attached to a support structure 11 which may comprise a building or other type of support structure. The lifting and lowering apparatus 10 may comprise one or more of each of the following elements: frame 12, pulleys 14, drive member 16, cable retraction device 18, lift cable 20, lift cable conduit tube 22, moveable payload attachment member 24, attachment member guide 26, alignment guide 28, automatic locking mechanism 30, network cable 32, network conduit tube 34, and network cable shuttle 36. The moveable payload attachment member 24 is defined as a member for supporting/attaching to the payload 38. The moveable payload attachment member 24 may be attached to the payload 38 using fasteners 39. The lifting and lowering apparatus 10 may be adapted to lift and/or lower a payload 38 attached to the moveable payload attachment member 24 from a starting position 40 to a payload final installation position 42 without the use of external lift equipment, such as forklifts, cranes, and/or other types of equipment, in order to allow for simple and time-efficient installation, removal, and/or maintenance of the payload 38, while increasing safety. The starting position 40 may comprise a position near or on a ground surface 41. In other embodiments, the starting position 40 may vary. The final installation position 42 may comprise a raised and/or lowered position relative to the starting position 40. In other embodiments, the final installation position 42 may vary. The payload 38 may comprise active components, such as an electronic device, a cell-phone, an antenna, a wireless access point, a camera, a microphone, a solar power device, a computer, a network, a wireless electronic device, a wireless router, lighting equipment, and/or another type of active payload; or it may include passive items, such as signs, billboards, artwork, and/or other passive payloads.

The frame 12 may attach the lifting and lowering apparatus 10 to the support structure 11. The frame 12 may comprise attachment brackets 12*a*, attachment members 12*b*, and/or other types of devices for attaching the lifting and lowering apparatus 10 to the support structure 11. The cable 20 may be attached to the drive member 16 at or near the starting position 40, may extend around the pulleys 14, may extend through the cable conduit tube 22, and may be attached to at least one of the moveable payload attachment member 24 and the attachment member guide 26. The drive member 16 may be adapted to drive the cable 20 forward and backwards in order to lift and lower the moveable payload attachment member 24 and the attached payload 38 between the starting position 40 and the payload final installation position 42. The drive member 16 may comprise a winch, a clutch, a non-back-drivable mechanism, an indicator for indicating when the moveable payload attachment member 24 and the attached payload 38 is located at the final installation position 42, and/or other type of device for moving the cable 20 in order to lift and/or lower the moveable payload attachment member 24 and the attached payload 38. The cable conduit tube 22 may comprise one or more hollow tubular members for protecting the cable 20.

The attachment member guide 26 may be attached to the moveable payload attachment member 24 using fasteners 25. The attachment member guide 26 may comprise a cylinder 26*a* having at least one angled surface 26*b* and at least one slot 26*c*. In the embodiment shown, the cylinder 26*a* comprises four angled surfaces 26*b* forming two identical opposing V-shapes 26*d*, and the cylinder 26*a* has two identical opposing slots 26*c* (the opposing slot is hidden from view) extending from the lowest points 26*e* of the respective V-shapes down the outer surface 26*f* of the cylinder 26*a*. In other embodiments, the shape, size, and/or configuration of the attachment member guide 26 may vary.

The alignment guide 28 may be fixedly attached to the frame 12 at the payload final installation position 42 using fasteners 29. The alignment guide 28 may comprise a plate 28*a* having at least one angled surface 28*b* and at least one alignment channel 28*c*. In the embodiment shown, the plate 28*a* comprises two opposing identical angled surfaces 28*b*, a flat surface 28*c* disposed between the angled surface 28*b*, and two opposing alignment channels 28*c*. In other embodiments, the shape, size, and/or configuration of the alignment guide 28 may vary.

The network cable 32 may be adapted to connect to the payload 38 in order to send and/or receive electronic signals to the payload 38 and/or power the payload 38. The cable retraction device 18 may comprise a passive cable retraction device for passively retracting the network cable 32 using an extension cord 18*a* which may be adapted to attach and detach from the network cable shuttle 36. One or more network conduit tubes 34, which may comprise one or more hollow tubular members, may be disposed over the network cable 32 to provide protection to the end connector 32*a* (shown in FIG. 2) of network cable 32. The network cable shuttle 36 may comprise an access point for accessing the network cable 32 and the extension cord 18*a* connection in order to attach and/or detach the network cable 32 from the extension cord 18*a*.

Figure 2:
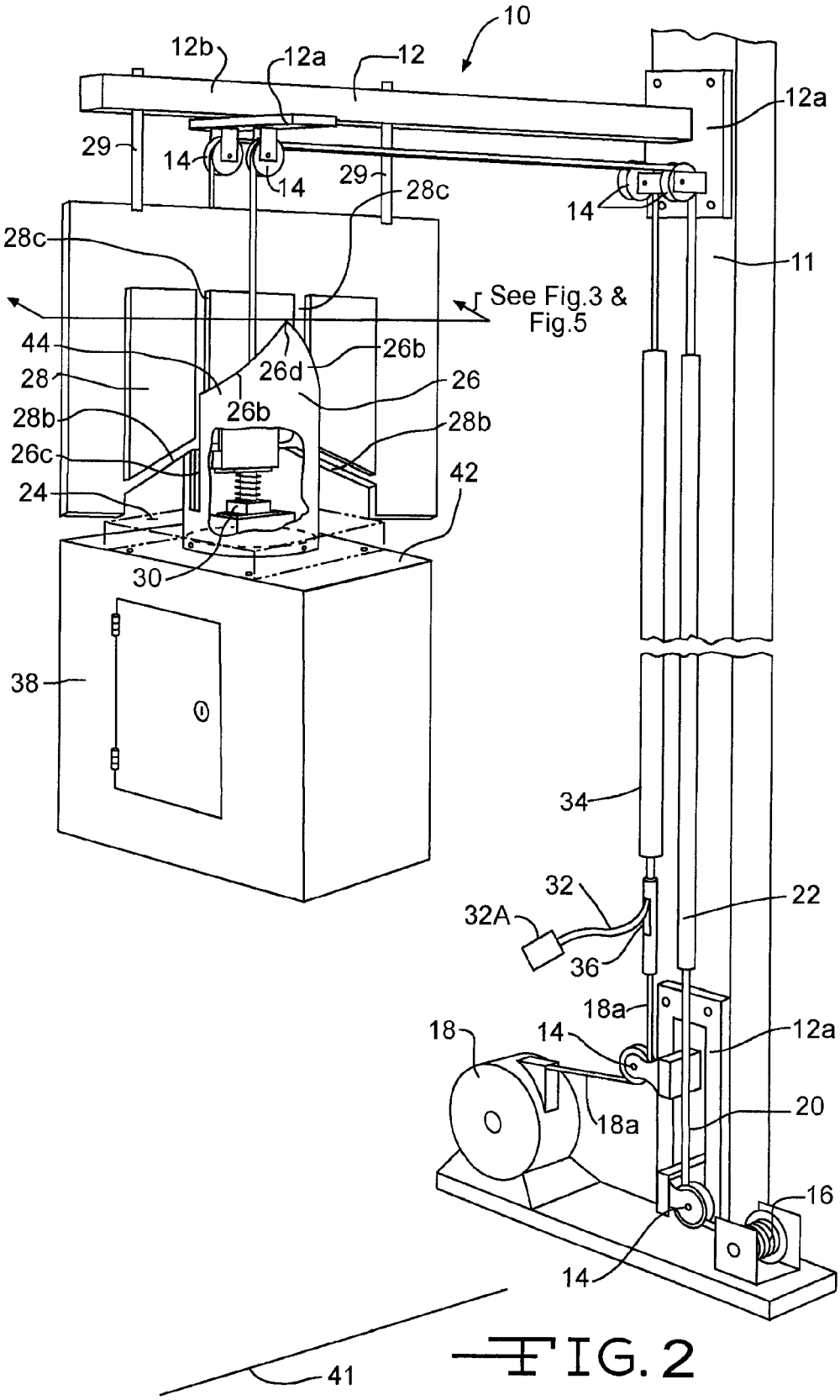
FIG. 2 is a perspective view of the lifting and lowering apparatus of FIG. 1 with the payload having been moved to a payload final installation position.

FIG. 2 is a perspective view of the lifting and lowering apparatus 10 of FIG. 1 with the payload 38 having been moved to the payload final installation position 42. The attachment member guide 26 and the alignment guide 28 may be shaped to mate in order to force the attachment member guide 26 into only one predetermined mating position 44 against the alignment guide 28 at the payload final installation position 42. In this only one predetermined mating position 44, the slots 26*c* of the attachment member guide 26 may be disposed within the alignment channels 28*c* of the alignment guide 28 in order to prevent the attachment member guide 26, the moveable payload attachment member 24, and the attached payload 38 from rotating once it has been aligned in the mating orientation. Achieving the proper rotation/orientation for the final mating position 44 requires components that may alter the orientation of payload 38 as it is being move into position. As the payload 38 is being lifted by cable 20, its orientation may become misaligned before it reaches the installation location 42. The alignment components will realign the payload orientation just prior to the mating of slots 26*c* and channel 28*c*. Due to the mating shapes of the attachment member guide 26 and the alignment guide 28, the payload rotation/orientation may be corrected (by up to 90 degrees in either direction for the embodiment described) for a misaligned member guide 26 when it initially comes in contact with the alignment guide 28. As the moveable payload attachment member 24 and the payload 38 approach the payload final installation position 42, the attachment member guide 26 will be forced into the only one predetermined mating position 44 thereby disposing the payload 38 in the payload final installation position 42. This is because as the angled surfaces 26*b* of the attachment member guide 26 initially come into contact with the opposing angled surfaces 28*b* of the alignment guide 28, the opposing angled surfaces 28*b* will force the angled surfaces 26*b* to slide along the opposing angled surfaces 28*b* to funnel the slots 26*c* into the alignment channels 28*c*. In such manner, the attachment member guide 26 may be forced into the only one predetermined mating position 44 with the alignment guide 28 in order to always locate the payload 38 in the payload final installation position 42. In other embodiments the sizes, shapes, and/or configurations of the attachment member guide 26 and the alignment guide 28 may be varied in order to force the attachment member guide 26 into only one predetermined mating position 44 with the alignment guide 28 in order to always locate the payload 38 in the payload final installation position 42.

Figure 3:
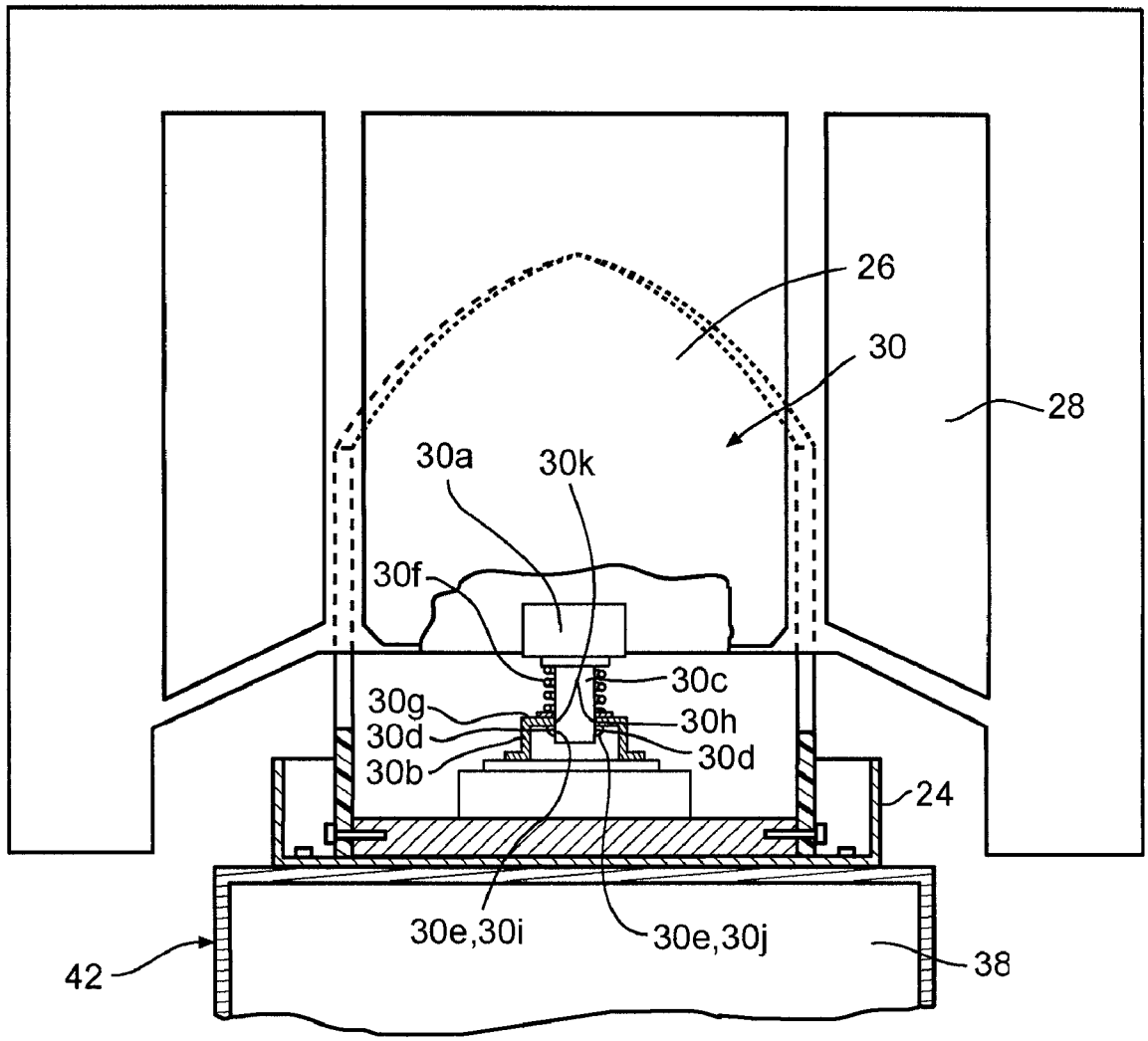
FIG. 3 is a partial cross-sectional view along the line marked in FIG. 2 showing one embodiment of an automatic locking mechanism which may be used to automatically lock and unlock the payload in place at the payload final installation position.

FIG. 3 shows a partial cross-sectional view along the marked line of FIG. 2 showing one embodiment of an automatic locking mechanism 30 for automatically locking and unlocking the moveable payload attachment member 24 and/or the attachment member guide 26 to and/or from the alignment guide 28 when the payload 38 is in the payload final installation position 42. The automatic locking mechanism 30 may comprise a two-stage latch comprising locking part 30*a* attached to the alignment guide 28 and mating locking part 30*b* attached to the attachment member guide 26. The automatic locking mechanism may alternate between locked and unlocked states, changing to the alternate state on each subsequent compression. An example of a commercially available latch that performs this task is the A4-Pin Latch made by Southco Manufacturing, Ltd. Locking part 30*a* may comprise a shaft 30*c* defined by a slot 30*d*, a moveable butterfly-shaped cam element 30*e* disposed in the slot 30*d*, and a spring 30*f*. Locking part 30*b* may comprise a receptacle member 30*g* defined by a hole 30*h*. As shown in FIG. 1, when the locking part 30*a* and the locking part 30*b* are disposed apart from each other, the cam 30*e* may be disposed within the slot 30*d* of the shaft 30*c*. As shown in FIGS. 2 and 3, when the locking part 30*a* contacts the locking part 30*b*, the shaft 30*c* may extend into the hole 30*h*, the spring 30*f* may compress against the receptacle member 30*g*, the butterfly cam 30*e* may extend out of the slot 30*d*, and the arms 30*i* and 30*j* of the butterfly-shaped cam 30*e* may extend laterally within the hole 30*h* and lock onto the perimeter surface 30*k* of the hole 30*h*. In such manner, the locking part 30*a* may automatically lock to the locking part 30*b* when the payload 38 is in the payload final installation position 42 to prevent the moveable payload attachment member 24 and the attachment member guide 26 from moving relative to the alignment guide 28. To release the locking part 30*a* from the locking part 30*b* after they are locked together, the drive member 16 (not shown) may lift the moveable payload attachment member 24 and the attachment member guide 26 upward to retract the arms 30*i* and 30*j* of the butterfly cam 30*e* back into the slot 30*d*, and then the payload 38 may be lowered back to the starting position 40 (not shown).

Figure 4:
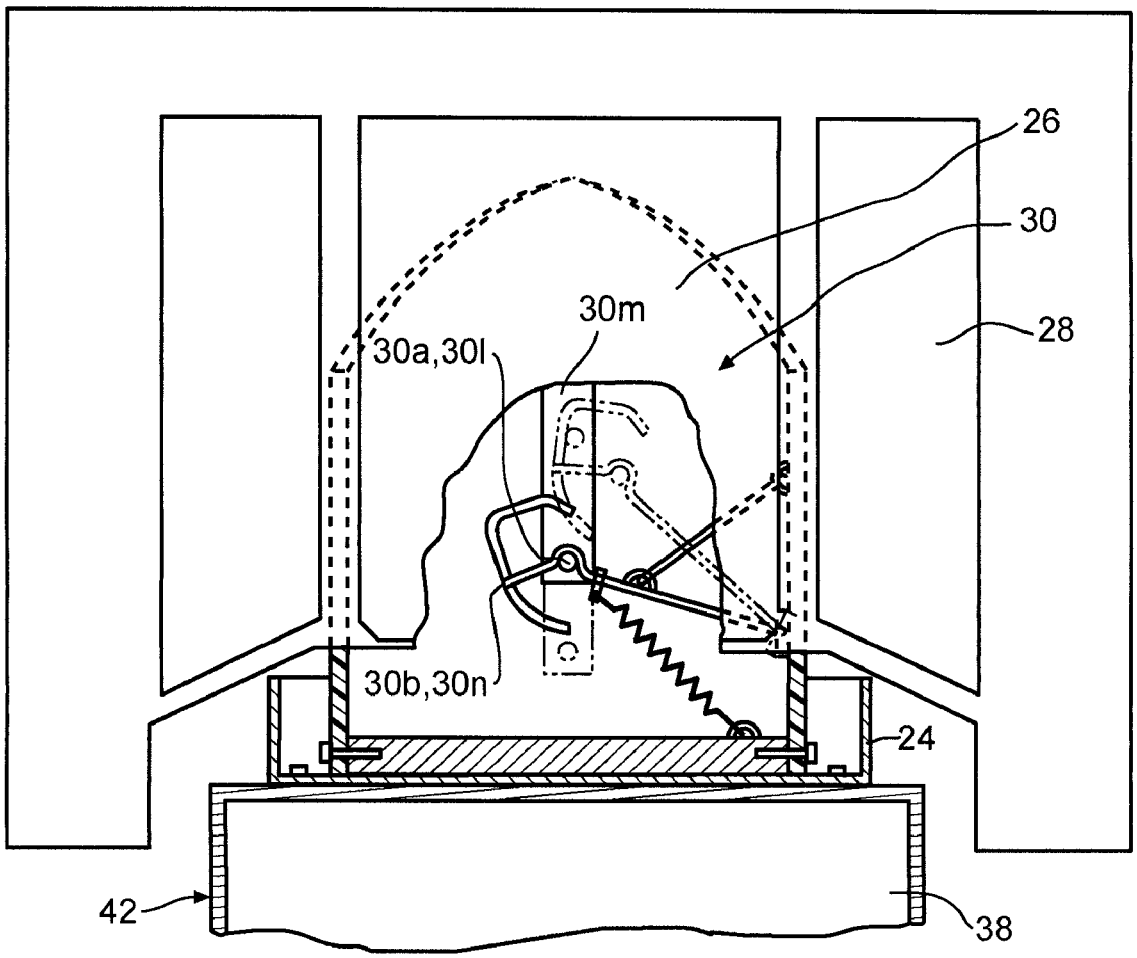
FIG. 4 is a partial cross-sectional view of another embodiment of an automatic locking mechanism which may be used to automatically lock and unlock the payload of FIG. 2 in place at the payload final installation position.

In other embodiments, other automatic locking mechanisms may be used for the locking parts 30*a* and 30*b*. For instance, in another embodiment as shown in FIG. 4, locking part 30*a* may comprise a pin 30*l* on load transfer member 30*m*, and locking part 30*b* may comprise a pivoting hook 30*n* that may catch and constrain pin 30*l* on the initial motion cycle and then releases it on the next cycle. In still other embodiments, other types of automatic locking mechanisms may be used which are designed to automatically lock and/or unlock the attachment member guide 26 to and/or from the alignment guide 28 when the payload 38 is in the payload final installation position 42.

Figure 5:
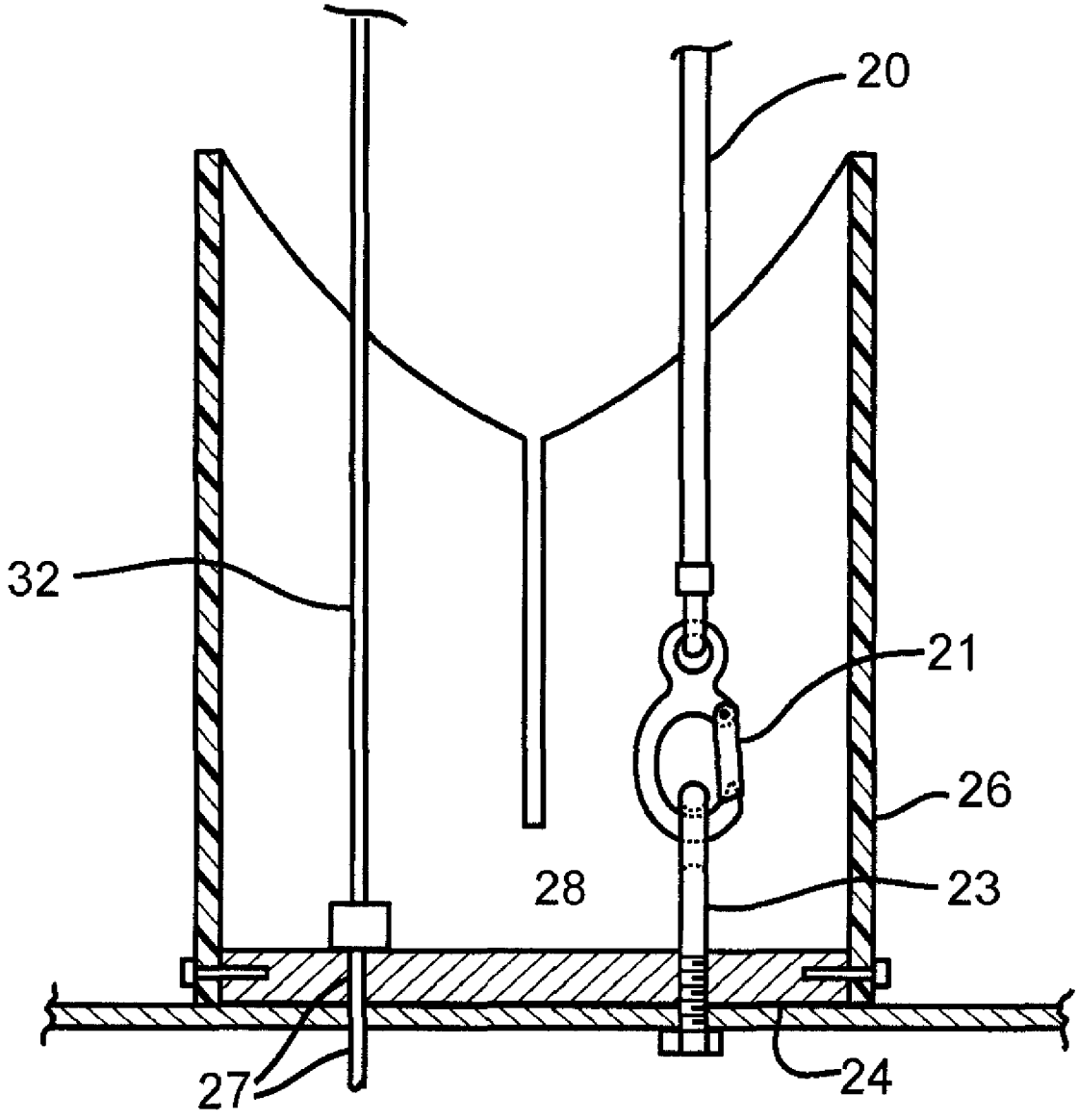
FIG. 5 shows a partial cross-sectional view along the line marked in FIG. 2 showing the attachment of cables.

FIG. 5 shows a partial cross-sectional view along the marked line of the embodiment of FIG. 2. As shown, the cable 20 may be locked to the moveable payload attachment member 24 and the attachment member guide 26 using a hook 21 connected to a fastener 23. In other embodiments, varying attachment devices may be utilized. The network cable 32 may extend through a hole 27 running through the moveable payload attachment member 24 and the attachment member guide 26 to the payload 38 (not shown). In other embodiments, the cable 32 may run to the payload 38 in different manners.

Figure 6:
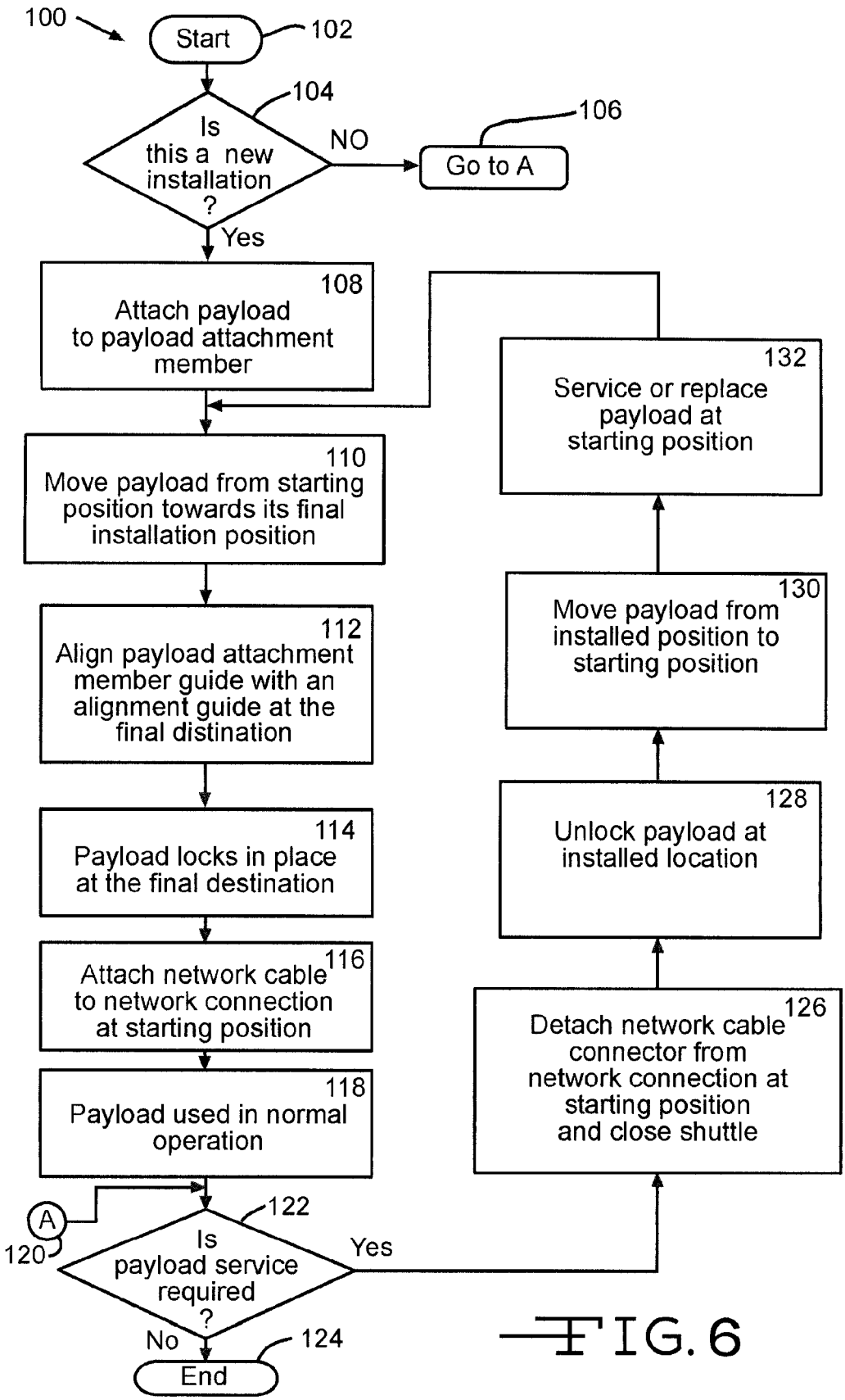
FIG. 6 is a flowchart of one embodiment of a method of system operation for moving a payload.

FIG. 6 is a flowchart of one embodiment of a method 100 of moving a payload 38. The method 100 may utilize any of the lifting and lowering apparatus 10 elements disclosed in this application. The method 100 may not require the use of lift equipment, such as forklifts, cranes, and/or other types of equipment, in order to install, remove, and/or maintain the payload 38. Beginning at step 102 and then moving to decision block 104, a new or existing installation is specified. For a new installation in step 108, a payload 38 may be attached to a payload attachment member 24. The payload attachment member 24 may be connected to at least one cable 20 extending around at least one pulley 14.

In step 110, the payload 38 and the payload attachment member 24 may be moved from the starting position 40 to the payload final, installation position 42 using at least one drive member 16 to move the cable 20. In step 112, an attachment member guide 26 attached to the payload attachment member 24 may be aligned with the alignment guide 28 at the payload final installation position 42 to force the attachment member guide 26 into only one pre-determined mating position 44 relative to the alignment guide 28. During step 112, the payload attachment member guide 26 may pivot around a vertical axis due to interaction with the alignment guide 28. Step 112 may comprise at least one angled surface 26*b* of the attachment member guide 26 sliding along at least one angled surface 28*b* of the alignment guide 28. Step 112 may further comprise at least one channel 28*c* of the alignment guide 28 being disposed in at least one slot 26*c* of the attachment member guide 26 to prevent the attachment member guide 26 from rotating. In step 114, the attachment member guide 26 of the payload attachment member 24 may be locked in the pre-determined mating position 44 relative to the alignment guide 28 to secure the payload 38 in place at the payload final installation position 42. Step 114 may utilize an automatic locking mechanism 30. In step 116, the network cable 32 extending over the another pulley 14 and attached to the payload 38 may be attached to the passive cable retraction device 18 after the payload 38 is secured in place at the payload final installation position 42. In step 118 the payload 38 may be put into its normal operating mode.

In the decision step 104, if the system is already installed and some type of payload service is required, the operation may proceed through step 106 to point A at step 120 and then onto another decision block at step 122. Note that step 122 can also be reached after processing step 118. In step 122, the choice may be made regarding servicing the payload. If service is not required the process may end at step 124. If service is required, the process may proceed to step 126.

In step 126, the network cable connector 32*a* may be disconnected from the building network port at the base of apparatus 10 and the opening in the network cable shuttle may be closed to protect the cable connector 32*a* as the cable moves through the conduit 34. In step 128, the attachment member guide 26 attached to the payload attachment member 24 may be unlocked from its pre-determined mating position 44 relative to the alignment guide 28 at the payload final installation position 42. In step 130, the payload 38 and the payload attachment member 24 may be moved from the payload final installation position 42 to the starting position 40 using the at least one drive member 16 to move the cable 20. In step 132, the payload 38 may be maintained/serviced/replaced at the starting position 40. At this point the process may repeat the steps starting at step 110 to move the payload 38 back to the installed location 42. In other embodiments, one or more steps of the method 100 may not be followed or may be altered, other steps may be added, and/or the steps may be done in a varying order.

One or more embodiments of the application may eliminate the need for technicians to be moved from a starting location to a final payload installation location in order to install, maintain, remove, and/or replace a payload. Using one or more embodiments of the application, a payload may be easily moved, without the need for lift equipment, back and forth between the starting location and the final payload installation location with minimum effort. This may save money, reduce service time, increase safety, eliminate the need for lift equipment, reduce the need for multiple service technicians, and/or reduce or eliminate one or more additional types of problems encountered by one or more of the conventional methods and/or apparatus.

It should be understood, of course, that the foregoing relates to exemplary embodiments of the disclosure and that modifications may be made without departing from the spirit and scope of the disclosure as set forth in the following claims.

We claim:

1. A lifting and lowering apparatus comprising:

at least one cable;

at least one pulley connected to said at least one cable;

at least one drive member connected to said at least one cable for driving said at least one cable in at least one direction;

a moveable payload attachment member for attaching to a payload to be at least one of lifted or lowered, wherein said moveable payload attachment member is configured to be at least one of lifted or lowered by said at least one cable;

an attachment member guide connected to the moveable payload attachment member; and an alignment guide, wherein the attachment member guide is configured to mate with the alignment guide to prevent the attachment member guide from rotating relative to the alignment guide.

2. The lifting and lowering apparatus of claim 1 wherein the lifting and lowering apparatus is attached to a building.

3. The lifting and lowering apparatus of claim 1 further comprising a second cable for connecting to the payload and a passive cable retraction device, wherein the passive cable retraction device is adapted to passively retract the second cable.

4. The lifting and lowering apparatus of claim 3 further comprising at least one conduit tube disposed over the second cable and a cable shuttle for accessing the second cable.

5. The lifting and lowering apparatus of claim 3 wherein the second cable comprises a network cable.

6. The lifting and lowering apparatus of claim 1 further comprising at least one cable conduit tube disposed over said at least one cable.

7. The lifting and lowering apparatus of claim 1 wherein said at least one drive member comprises a winch.

8. The lifting and lowering apparatus of claim 7 wherein said winch comprises at least one of a clutch, a non-back-drivable transmission, or an indicator for indicating when said attachment member guide is mated with the alignment guide preventing the attachment member guide from rotating relative to the alignment guide.

9. The lifting and lowering apparatus of claim 1 further comprising the payload, wherein the payload comprises at least one of an electronic device, a cell-phone, an antenna, a wireless access point, a camera, a microphone, a solar power device, a computer, a network, a wireless electronic device, a wireless router, lighting equipment, a sign, or artwork.

10. The lifting and lowering apparatus of claim 1 wherein the attachment member guide comprises at least one angled surface and at least one slot extending over and along an outer surface of said attachment member guide.

11. The lifting and lowering apparatus of claim 1 wherein the alignment guide comprises a plate having at least one angled surface and at least one alignment channel extending over and along an outer surface of said alignment guide.

12. The lifting and lowering apparatus of claim 1 further comprising an automatic locking mechanism for automatically locking and unlocking at least one of the moveable payload attachment member or the attachment member guide to and from the alignment guide.

13. The lifting and lowering apparatus of claim 12 wherein the automatic locking mechanism comprises at least one of: a two-stage latch; a moveable cam defined in a slot of a shaft, a spring, and a receptacle; or a pivoting hook and a pin.

14. The lifting and lowering apparatus of claim 1 wherein the attachment member guide comprises a hollow cylinder.

15. The lifting and lowering apparatus of claim 14 wherein the hollow cylinder comprises an outer surface, the outer surface comprising at least one slot extending along a side of the hollow cylinder and an angled surface extending at a top of the hollow cylinder.

16. The lifting and lowering apparatus of claim 15 wherein the angled surface forms a V shape.

17. The lifting and lowering apparatus of claim 1 wherein the alignment guide comprises a linear plate comprising at least one alignment channel extending linearly along the linear plate.

18. A method of moving a payload comprising:

attaching a payload to a payload attachment member connected to at least one cable;

moving the payload and payload attachment member from a starting position to another position by using at least one drive member to move the cable; and aligning an attachment member guide attached to the payload attachment member with an alignment guide at the another position to prevent the attachment member guide from rotating relative to the alignment guide.

19. The method of claim 18 wherein the payload comprises at least one of an electronic device, a cell-phone, an antenna, a wireless access point, a camera, a microphone, a solar power device, a computer, a network, a wireless electronic device a wireless router, lighting equipment, a sign, or artwork.

20. The method of claim 18 further comprising the step of detaching a second cable attached to the payload from a passive cable retraction device prior to moving the payload and payload attachment member from the starting position to the another position.

21. The method of claim 20 wherein the second cable comprises a network cable.

22. The method of claim 18 wherein said at least one drive member comprises a winch.

23. The method of claim 22 wherein said winch comprises at least one of a clutch, a non-back-drivable transmission, or an indicator for indicating when said attachment member guide is aligned with the alignment guide at the another position preventing the attachment member guide from rotating relative to the alignment guide.

24. The method of claim 18 wherein the attachment member guide comprises at least one angled surface and at least one slot extending over and along an outer surface of said attachment member guide.

25. The method of claim 18 wherein the alignment guide comprises a plate having at least one angled surface and at least one alignment channel extending over and along an outer surface of said alignment guide.

26. The method of claim 18 further comprising automatically locking the attachment member to the alignment guide at the another position to secure the payload in place at the another position.

27. The method of claim 26 wherein the automatically locking step is done using an automatic locking mechanism comprising at least one of: a two-stage latch; a moveable cam defined in a slot of a shaft, a spring, and a receptacle; or a pivoting hook and a pin.

28. The method of claim 26 further comprising the steps of unlocking the attachment member guide from the alignment guide at the another position, moving the payload and payload attachment member from the another position to the starting position using the at least one drive member to move the cable, and maintaining the payload at the starting position.

29. The method of claim 18 wherein the aligning step comprises at least one channel of the alignment guide being disposed in at least one slot of the attachment member guide to prevent the attachment member guide from rotating relative to the alignment guide.

30. The method of claim 18 wherein the aligning step comprises at least one angled surface of the attachment member guide sliding along at least one angled surface of the alignment guide.

31. The method of claim 18 further comprising the step of attaching a second cable attached to the payload to a passive cable retraction device after the attachment member guide is aligned with the alignment guide at the another position at the another position.

32. The method of claim 31 wherein the second cable comprises a network cable.

33. The method of claim 18 wherein the attachment member guide comprises a hollow cylinder.

34. The method of claim 33 wherein the hollow cylinder comprises an outer surface, the outer surface comprising at least one slot extending along a side of the hollow cylinder and an angled surface extending at a top of the hollow cylinder.

35. The method of claim 34 wherein the angled surface forms a V shape.

36. The method of claim 18 wherein the alignment guide comprises a linear plate comprising at least one alignment channel extending linearly along the linear plate.

* * * * *